US011053096B2

(12) United States Patent
Agirman

(10) Patent No.: US 11,053,096 B2
(45) Date of Patent: Jul. 6, 2021

(54) AUTOMATIC RESCUE AND CHARGING SYSTEM FOR ELEVATOR DRIVE

(71) Applicant: Otis Elevator Company, Farmington, CT (US)

(72) Inventor: Ismail Agirman, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 709 days.

(21) Appl. No.: 15/688,288

(22) Filed: Aug. 28, 2017

(65) Prior Publication Data

US 2019/0062111 A1 Feb. 28, 2019

(51) Int. Cl.

*B66B 5/02* (2006.01)
*B66B 5/00* (2006.01)
*B66B 1/30* (2006.01)

(52) U.S. Cl.

CPC ..... *B66B 5/028* (2013.01); *B66B 1/306* (2013.01); *B66B 5/0031* (2013.01); *B66B 5/027* (2013.01)

(58) Field of Classification Search

CPC .. B66B 1/30; B66B 5/02; B66B 1/302; B66B 1/308; B66B 1/32; B66B 11/04; B66B 1/28; B66B 5/0031; B66B 5/10; B66B 1/306; B66B 5/0025; B66B 5/0093; B66B 5/021; B66B 5/044; B66B 5/06; B66B 1/3407; B66B 23/02; B66B 3/002; B66B 5/0006; B66B 5/0018; B66B 5/0037; B66B 5/024; B66B 5/028; B60T 17/22; B60T 7/085; G10H 1/40; G10H 2220/525; G10H 2240/145; G10H 2250/641; G10H 2210/341; G10H 2210/115; G10H 2210/071; G10H 2210/381; G10H 2210/366; G10H 2230/275; G10H 3/14; G10H 2210/356; G10D 13/02; G10D 13/26; G10D 13/00; G10D 13/03; G10D 13/20; G10D 13/01

See application file for complete search history.

(56) References Cited

U.S. PATENT DOCUMENTS

| | | | |
|---|---|---|---|
| 3,986,097 | A | 10/1976 | Woods |
| 4,736,151 | A | 4/1988 | Dishner |
| 4,894,765 | A | 1/1990 | Kahkipuro |
| 5,058,710 | A | 10/1991 | Iwasa |
| 5,893,432 | A | 4/1999 | Nguyen et al. |
| 6,454,053 | B2 | 9/2002 | Tominaga et al. |
| 6,522,099 | B2 | 2/2003 | Tominaga et al. |

(Continued)

FOREIGN PATENT DOCUMENTS

| | | | |
|---|---|---|---|
| CN | 102020153 | A | 4/2011 |
| CN | 203345880 | U | 12/2013 |

(Continued)

*Primary Examiner* — Marlon T Fletcher
(74) *Attorney, Agent, or Firm* — Cantor Colburn LLP

(57) ABSTRACT

A method and system for providing power to an elevator hoist motor is disclosed. An isolated bi-directional dc/dc converter is coupled between a power converter and a power inverter. A battery is coupled to the isolated bi-directional dc/dc converter. A processor is configured to sense power levels and couple the battery to an elevator hoist motor via the isolated bi-directional dc/dc converter depending on the voltage of the main power supply. The isolated bi-directional dc/dc converter is also configured to provide power to charge the battery.

16 Claims, 3 Drawing Sheets

(56) References Cited

U.S. PATENT DOCUMENTS

| | | | | |
|---|---|---|---|---|
| 6,732,838 | B1 | 5/2004 | Okada et al. | |
| 6,827,182 | B2 | 12/2004 | Araki | |
| 6,938,733 | B2 | 9/2005 | Eilinger | |
| 7,165,654 | B2 | 1/2007 | Takehara et al. | |
| 7,275,622 | B2 | 10/2007 | Hall et al. | |
| 7,549,515 | B2 | 6/2009 | Tegtmeier et al. | |
| 7,650,968 | B2 | 1/2010 | Oesterle et al. | |
| 7,690,483 | B2 | 4/2010 | Tegtmeier et al. | |
| 8,030,884 | B2 | 10/2011 | King et al. | |
| 8,146,714 | B2 | 4/2012 | Blasko | |
| 8,230,978 | B2 | 7/2012 | Agirman et al. | |
| 8,421,271 | B2 | 4/2013 | King et al. | |
| 8,638,055 | B2 | 1/2014 | Kallioniemi | |
| 9,296,589 | B2 | 3/2016 | Marvin | |
| 9,440,819 | B2 | 9/2016 | Rossignol | |
| 9,520,718 | B2 | 12/2016 | Cui | |
| 9,584,047 | B2 | 2/2017 | Frohman et al. | |
| 9,586,789 | B2 | 3/2017 | Agirman et al. | |
| 9,601,945 | B2 | 3/2017 | Hall | |
| 2008/0073157 | A1 | 3/2008 | Kanon et al. | |
| 2010/0044160 | A1* | 2/2010 | Agirman | B66B 5/027 187/290 |
| 2011/0144810 | A1* | 6/2011 | Wesson | B66B 5/027 700/275 |
| 2011/0147130 | A1* | 6/2011 | Oggianu | B66B 1/302 187/290 |
| 2011/0226559 | A1* | 9/2011 | Chen | G01R 35/005 187/290 |
| 2012/0085593 | A1* | 4/2012 | Schoenauer | B66B 5/027 187/254 |
| 2014/0008155 | A1* | 1/2014 | Rossignol | B66B 1/302 187/290 |
| 2014/0209415 | A1* | 7/2014 | Hall | H02J 9/062 187/290 |
| 2015/0122589 | A1 | 5/2015 | Mezzadri et al. | |
| 2015/0136531 | A1* | 5/2015 | Rogers | B66B 5/027 187/290 |
| 2016/0083220 | A1 | 3/2016 | Agirman et al. | |
| 2016/0229666 | A1 | 8/2016 | Gewinner et al. | |
| 2017/0107077 | A1 | 4/2017 | Prakash | |

FOREIGN PATENT DOCUMENTS

| | | | |
|---|---|---|---|
| EP | 3156358 | A1 | 4/2017 |
| WO | 2010059139 | A1 | 5/2010 |

* cited by examiner

AUTOMATIC RESCUE AND CHARGING SYSTEM FOR ELEVATOR DRIVE

BACKGROUND

Exemplary embodiments pertain to the art of power systems. In particular, the present disclosure relates to a power system for use with elevator systems to provide battery-based power during normal and power failure conditions.

An elevator drive system is typically designed to operate over a specific input voltage range from a power source. The components of the drive have voltage and current ratings that allow the drive to continuously operate while the power supply remains within the designated input voltage range. However, voltage sags, brownout conditions (i.e., voltage conditions below the tolerance band of the drive) and/or power loss can cause issues. When utility voltage sags occur, the drive draws more current from the power supply to maintain uniform power to the hoist motor. In conventional systems, when excess current is being drawn from the power supply, the drive will shut down to avoid damaging the components of the drive.

When a power sag or power loss occurs, the elevator car may become stalled between floors in the elevator hoistway until the power supply returns to the nominal operating voltage range. In conventional systems, passengers in the elevator may be trapped until a maintenance worker is able to release a brake for controlling cab movement upwardly or downwardly to allow the elevator to move to the closest floor. More recently, elevator systems employing automatic rescue systems have been introduced. These elevator systems include electrical energy storage devices (such as one or more batteries) that are controlled after power failure to provide power to move the elevator to the next floor for passenger disembarkation. However, many current automatic rescue operation systems are complex and expensive to implement, and may provide unreliable power to the elevator drive after a power failure.

BRIEF DESCRIPTION

According to one embodiment, a method of driving an elevator an comprise monitoring a voltage level of a power supply. Based on a determination that the voltage level of the main power supply is below a first predetermined threshold, directing an isolated bi-directional dc/dc converter to boost a voltage input from a battery to a level sufficient to drive the elevator car in a rescue mode.

In addition to one or more features described above, or as an alternative, further embodiments may include wherein the level sufficient to drive the elevator car in the rescue mode ranges from 70 to 300 volts.

In addition to features described above, or as an alternative, further embodiments may include monitoring a voltage level of the battery; and based on a determination that the voltage level of the battery is below a second predetermined threshold and a determination that the voltage level of the main power supply is above the first predetermined threshold, charging the battery via the isolated bi-directional dc/dc converter.

In addition to features described above, or as an alternative, further embodiments may include monitoring a temperature of the battery; wherein charging the battery comprises: determining an optimum charging cycle for the battery using the voltage level of the battery and the temperature of the battery; and applying the optimum charging cycle to the battery.

In addition to features described above, or as an alternative, further embodiments may include wherein charging the battery comprises using power from the main power supply to charge the battery.

In addition to features described above, or as an alternative, further embodiments may include wherein charging the battery comprises using power from an elevator hoist motor operating in a regenerative mode to charge the battery.

In addition to features described above, or as an alternative, further embodiments may include wherein the isolated bi-directional dc/dc converter is configured to receive a line voltage as input and output a voltage optimal to charge the battery.

In addition to features described above, or as an alternative, further embodiments may include wherein the battery is a 48 volt battery and the voltage optimal to charge the battery is in the range of 50 to 55 volts.

In addition to features described above, or as an alternative, further embodiments may include wherein the line voltage is approximately 480 volts.

According to one embodiment, an elevator power system can comprise: an input coupled to a main power supply; a power converter coupled to the input configured to convert between alternating current and direct current; a power inverter coupled to the power converter configured to convert between alternating current and direct current; a hoist motor coupled to the power inverter configured to have a regenerative mode; an isolated bi-directional dc/dc converter coupled between the power converter and the power inverter; a battery coupled to the isolated bi-directional dc/dc converter; and a processor coupled to the isolated bi-directional dc/dc converter; wherein the processor is configured to change the mode of operation of the isolated bi-directional dc/dc converter depending on voltage sensed from the power converter and voltage sensed from the battery.

In addition to features described above, or as an alternative, further embodiments may include wherein the processor is configured to: based on a determination that the voltage level of the main power supply is below a first predetermined threshold, directing an isolated bi-directional dc/dc converter to boost a voltage input from a battery to a level sufficient to drive the hoist motor in a rescue mode.

In addition to features described above, or as an alternative, further embodiments may include wherein the level sufficient to drive the hoist motor in the rescue mode ranges from 70 to 300 volts.

In addition to features described above, or as an alternative, further embodiments may include wherein the processor is further configured to: monitor a voltage level of the battery; based on a determination that the voltage level of the battery is below a second predetermined threshold and a determination that the voltage level of the main power supply is above the first predetermined threshold, charging the battery via the isolated bi-directional dc/dc converter.

In addition to features described above, or as an alternative, further embodiments may include wherein the processor is further configured to: monitor a temperature of the battery; wherein charging the battery comprises: determining an optimum charging cycle for the battery using the voltage level of the battery and the temperature of the battery; and applying the optimum charging cycle to the battery.

In addition to features described above, or as an alternative, further embodiments may include wherein: charging the battery comprises using power from the main power supply to charge the battery.

In addition to features described above, or as an alternative, further embodiments may include wherein charging the battery comprises using power from the hoist motor operating in a regenerative mode to charge the battery.

In addition to features described above, or as an alternative, further embodiments may include wherein the isolated bi-directional dc/dc converter is configured to receive a line voltage as input and output a voltage optimal to charge the battery.

In addition to features described above, or as an alternative, further embodiments may include wherein the battery is a 48 volt battery and the voltage optimal to charge the battery is in the range of 50 to 55 volts.

In addition to features described above, or as an alternative, further embodiments may include wherein the line voltage is approximately 480 volts.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Figure 1:
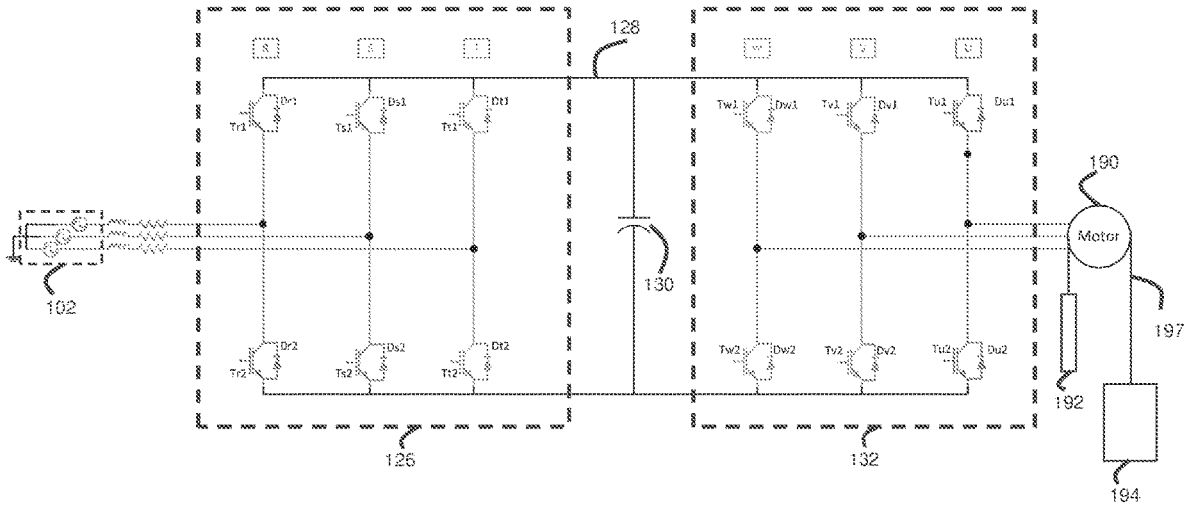
FIG. 1 is schematic view of a power system for driving an elevator hoist motor.

FIG. 1 is a schematic view of a regenerative drive system 100 for driving hoist motor 190 of elevator 197. System 100 is coupled to a main power supply 102. Main power supply 102 may be electricity supplied by an electric utility, such as a commercial power source. Elevator 197 includes elevator car 194 and counterweight 192 that are coupled together via cabling to hoist motor 190.

Power from main power supply 102 is illustrated as a three-phase circuit. However, it should be understood that, in some embodiments, main power supply 102 can be any type of power source, including a single-phase AC power source and a DC power source. Power supply 102 is coupled to power converter 126, power inverter 132.

Power converter 126 and power inverter 132 are connected by power bus 128. Smoothing capacitor 130 is connected across power bus 128. Power converter 126 may be a three-phase power inverter that is operable to convert three-phase AC power from main power supply 102 to DC power. In some embodiments, power converter 126 comprises a plurality of power transistor circuits including parallel connected transistors and diodes. The DC output power is provided by power converter 126 on DC power bus 128. Smoothing capacitor 130 smooths the power provided by power converter 126 and DC power bus 128. Power converter 126 is also operable to invert power on power bus 128 to be returned to main power supply 102. This regenerative drive configuration reduces the demand on main power supply 102.

Power inverter 132 may be a three-phase power inverter that is operable to invert DC power from power bus 128 to three-phase AC power. Power inverter 132 may comprise a plurality of power transistor circuits including parallel-connected transistors and diodes. Power inverter 132 delivers the three-phase power to hoist motor at the outputs of power inverter 132. In addition, power inverter 132 is operable to process power that is generated when elevator 194 drives hoist motor 190 in regenerative mode. For example, if hoist motor 190 is generating power, power inverter 132 converts the generated power and provides it to power bus 128. Smoothing capacitor 130 smooths the converted power provided on power bus 128 by power inverter 132. In one or more alternative embodiments, power inverter 132 is a single-phase power inverter that is operable to invert DC power from power bus 128 to single-phase AC power for deliver to hoist motor 190.

Hoist motor 190 controls the speed and direction of movement of elevator car 194 and counterweight 192. The power required to drive hoist motor 190 varies with the acceleration and direction of elevator car 194. For example, if elevator car 194 is being accelerated, run in an upward direction with a load greater than the weight of counterweight 192 (a "light" load), or run in a downward direction with a load more than the weight of counterweight 192 (a "heavy" load), a maximal amount of power is used to drive hoist motor 190. If elevator car 194 is leveling or running at a fixed speed with a balanced load, it may be using a lesser amount of power. If elevator car 194 is being decelerated, running in a downward direction with a heavy load, or running in an upward direction with a light load, elevator car 194 drives hoist motor 190. In this case, hoist motor 190 generates power that is converted to DC power by power inverter 132. The converted DC power may be returned to main power supply 102. In some embodiments, the converted DC power may be dissipated in a dynamic brake resistor (not shown) that is connected across power bus 128. Thus, because power may be generated by hoist motor 190 and returned to main power supply 102 during certain situations, the setup of system 100 can be referred to as a regenerative drive.

While only a single hoist motor 190 is illustrated in FIG. 1, it should be understood that main power supply 102 can be used to power multiple hoist motors, each of which used to drive an elevator car and counterweight. For example, multiple power inverters may be coupled in parallel across power bus 128 to provide power to multiple hoist motors.

In certain situations, it can be useful to have a battery that acts as a backup for main power supply 102. As stated above, people can become trapped in elevator car 194 if main power supply 102 stops providing sufficient power. This can be a traumatic experience for passengers. A battery backup can enable elevator car 194 to be moved to a safe location to disembark the passengers. Thereafter, elevator car 194 can be shut down to prevent others from becoming trapped in the elevator car until power supply 102 becomes operable again.

In one or more embodiments, a battery system is coupled to an elevator system to provide emergency backup power. In one or more configurations, an isolated bi-directional dc/dc converter can be used to couple the battery system to the power bus. The isolated bi-directional dc/dc converter can be configured to charge the battery system while the main power supply is operational and to couple the battery to the hoist motor when the main power supply is not operational, in order to perform a rescue operation.

Figure 2:
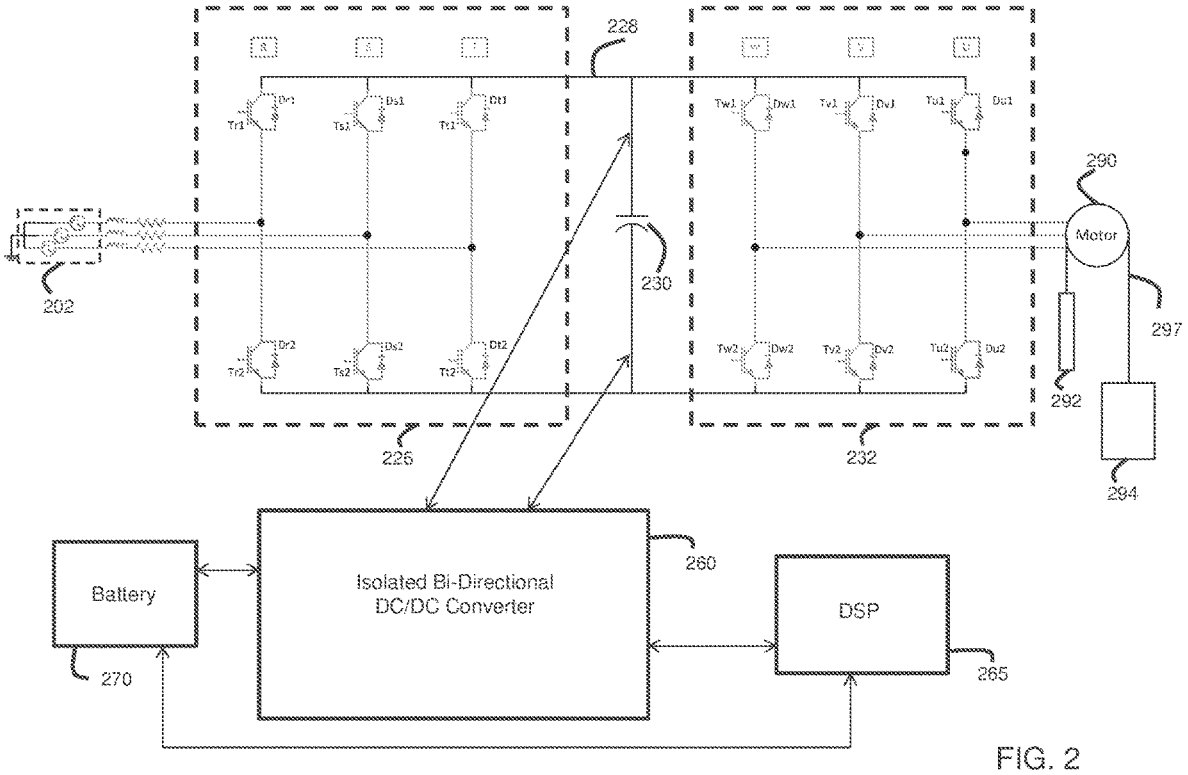
FIG. 2 is a schematic view of a power system incorporating one or more embodiments.

FIG. 2 is a schematic view of a regenerative system for driving hoist motor 290 of elevator 297. Main power supply 202 may include electricity supplied by an electric utility, such as a commercial power source. Elevator 297 includes elevator car 294 and counterweight 292 that are coupled together via cabling to hoist motor 290.

Power from main power supply 202 is illustrated as a three-phase circuit. However, it should be understood that, in some embodiments, main power supply 202 can be any type of power source, including a single-phase AC power source and a DC power source. Power supply 202 is coupled to power converter 226 and power inverter 232.

Power converter 226 and power inverter 232 are coupled together by power bus 228. Smoothing capacitor 230 is connected across power bus 228. Power converter 226 may be a three-phase power inverter that is operable to convert three-phase AC power from main power supply 202 to DC power. In some embodiments, power converter 226 comprises a plurality of power transistor circuits including one or more parallel connected transistors and diodes that serve to smooth current and to achieve low harmonic distortion. The DC output power is provided by power converter 226 on DC power bus 228. Smoothing capacitor 230 smooths the provided by power converter 226 and DC power bus 228. Power converter 226 is also operable to invert power on power bus 228 to be returned to main power supply 202. This regenerative configuration reduces the demand on main power supply 202.

Power inverter 232 may be a three-phase power inverter that is operable to invert DC power from power bus 228 to three-phase AC power. Power inverter 232 may comprise one or more power transistor circuits including parallel-connected transistors and diodes. Power inverter 232 delivers the three-phase power to hoist motor at the outputs of power inverter 232. In addition, power inverter 232 is operable to process power that is generated when elevator 294 drives hoist motor 290 in regenerative mode. For example, if hoist motor 290 is generating power, power inverter 232 converts the generated power to DC power and provides it to power bus 228. Smoothing capacitor 230 smooths the converted DC power provided on power bus 228 by power inverter 232. In one or more alternative embodiments, power inverter 232 is a single-phase power inverter that is operable to invert DC power from power bus 228 to single-phase AC power for deliver to hoist motor 290.

Hoist motor 290 controls the speed and direction of movement between elevator car 294 and counterweight 292. The power required to drive hoist motor 290 varies with the acceleration and direction of elevator car 294. For example, if elevator car 294 is being accelerated, run up with a load greater than the weight of counterweight 292 (a "heavy" load), or run down with a load less than the weight of counterweight 292 (a "light" load), a maximal amount of power is used to drive hoist motor 290. If elevator is leveling or running at a fixed speed with a balanced load, it may be using a lesser amount of power. If elevator car 294 is being decelerated, running down with a heavy load, or running up with a light load, elevator car 294 drives hoist motor 290. In this case, hoist motor 290 generates power that is converted to DC power by power inverter 232. The converted DC power may be returned to main power supply 202. In some embodiments, the converted DC power may be dissipated in a dynamic brake resistor (not shown) that is connected across power bus 228. Thus, because power may be generated by hoist motor 290 and returned to main power supply 202 during certain situations, the setup of the system of FIG. 2 can be referred to as a regenerative drive.

Coupled across power bus 228 is an isolated bi-directional dc/dc converter 260. Isolated bi-directional dc/dc converter 260 is coupled to a battery 270 and a drive digital signal processor (DSP) 265.

Battery 270 supplies power in the event of an emergency. In some embodiments, battery 270 can supply a voltage of 48 volts. In some embodiments, other voltage levels can be used, such as 24 volts or 12 volts. In some embodiments, battery 270 is a rechargeable battery, capable of being charged via main power supply 202, though the dc link and the isolated bi-directional dc/dc converter 260 when configured by DSP 265 to operate in charging mode. Note that the bi-directional dc/dc converter 260 has dual functions: in the presence of normal utility power mode, it is a charger for the battery 270, while in rescue mode bi-directional dc/dc converter 260 is configured by the DSP 265 to be a power source for the hoist motor 290 via connection to the dc link between power bus 228 and bi-directional dc/dc converter 260.

Drive DSP 265 controls the operation of isolated bi-directional dc/dc converter 260. Based on various factors, such as the voltage of battery 270 and the temperature of battery 270, the charging of battery 270 can be controlled by drive DSP 265. Drive DSP 265 is coupled to isolated bi-directional dc/dc converter 260 and can switch isolated bi-directional dc/dc converter 260 between the various modes.

In some embodiments, there can be several modes of operation of battery 270 and isolated bi-directional dc/dc converter 260. There can be a charging mode and a rescue mode.

In a charging mode, while main power supply 202 is being used to power hoist motor 290, some of the power is diverted by isolated bi-directional dc/dc converter 260 and is used to charge battery 270. This can be accomplished through various switching capabilities of isolated bi-directional dc/dc converter 260, which will be explained in detail later. In general, while in charging mode, DSP 265 monitors the temperature and voltage of battery 270. Using the temperature and voltage information, DSP can determine an optimal charging voltage and duty time and select an appropriate charging duty cycle and/or a charging voltage based on the temperature and voltage of battery 270. For example, with a 48 volt battery, the optimum charging voltage may be in the range of 50 to 55 volts. (For 12V or 24 volt batteries, these values gets adjusted according to charging requirements). Thus, one of a variety of different charging algorithms can be used that changes the charging voltage based on the temperature and voltage of battery 270 and the amount of time the battery is being charged. In some embodiments, the DSP 265 can be set to charge only in regenerative runs, such that power is not drawn from main power supply 202. In some embodiments, DSP 265 can be set to charge battery 270 at any time that battery 270 needs to be charged.

In a rescue mode, DSP 265 can detect that main power supply 202 is not providing sufficient power. In such a case, battery 270 is used to supply power to hoist motor 290 to enable hoist motor to guide elevator car 294 to a safe destination for passenger disembarkation. DSP 265 switches isolated bi-directional dc/dc converter 260 into a boost mode. In the boost mode, the voltage level of the battery (12 to 48 volts, in some embodiments) is boosted by isolated bi-directional dc/dc converter 260 to a voltage level sufficient to drive hoist motor 290. In some embodiments, that level is between 70 and 300 volts. While this is less than the 380 to 480 volts provide by main power supply 202, it should be sufficient to drive hoist motor 290 such that elevator car 294 can be moved to a safe level. The elevator car 294 can be moved in a direction that is helped by gravity or in a direction where the primary forces to be overcome are frictional forces. In other words, depending on the load of the car, the drive hoist motor 290 is directed in the direction that requires the least assistance from the motor. In the rescue mode, drive hoist motor 290 may be operated at a slower speed than normal operation, because of the lower voltage. Depending on the capacity of battery 270, there may be sufficient power to provide an additional run, if necessary.

In other situations, isolated bi-directional dc/dc converter 260 is configured such that it has no effect on the system of FIG. 2. In other words, isolated bi-direction dc/dc converter 260 has a minimal effect on the operation of hoist motor 290 when power is present and battery 270 is fully charged or otherwise cannot accept additional charge (e.g., battery 270 is at a certain temperature).

Figure 3:
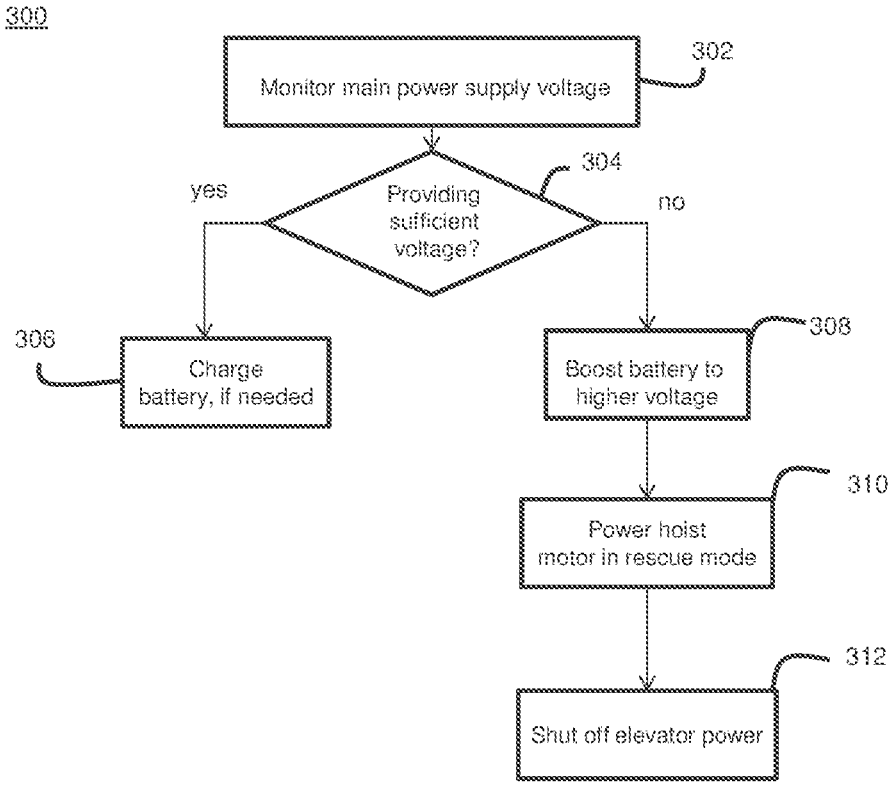
FIG. 3 is a flowchart illustrating the operation of one or more embodiments.

A flowchart illustrating method 300 is presented in FIG. 3. Method 300 is merely exemplary and is not limited to the embodiments presented herein. Method 300 can be employed in many different embodiments or examples not specifically depicted or described herein. In some embodiments, the procedures, processes, and/or activities of method 300 can be performed in the order presented. In other embodiments, one or more of the procedures, processes, and/or activities of method 300 can be combined or skipped. In one or more embodiments, method 300 is performed by a processor as it is executing instructions.

DSP 265 monitors voltage from a main power supply (block 302). If main power supply is providing sufficient voltage (block 304), then it is determined if a battery needs to be charged (block 306).

The DSP 265 also monitors various conditions of a battery, such as the voltage of the battery and the temperature of the battery. If the condition of the battery is such that charging is necessary, then the DSP 265 directs a bi-directional DC/DC converter to direct power from the main power supply to the battery. One of a variety of different algorithms can be used to charge the battery, based on the voltage of the battery and the temperature of the battery. A variety of different algorithms can be used, such as an algorithm can be chosen to maximize the life of the battery, or an algorithm to charge the battery as quickly as possible (e.g., the battery is in a drained state because it was used in rescue mode).

In some embodiments, the DSP 265 also monitors the direction of current on the bus. If the current is being directed to the power supply (such as a regenerative mode), only then is the battery being charged.

If main power supply is not providing sufficient voltage to drive the elevator hoist motor (e.g., a brownout or a blackout is present), then the DSP 265 directs the bi-directional DC/DC converter to convert the battery power to a voltage sufficient to drive the elevator hoist motor in a rescue mode (block 308). In some embodiments, such a voltage level can be in the range of 70 to 300 volts. Thereafter, bi-directional DC/DC converter is used in a rescue mode for a period of time (block 310). In some embodiments, the rescue mode can be used for a predetermined number of trips. For example, the elevator car may be safely brought to a predetermined level to ensure until no passengers are in the elevator car. In some embodiments, the elevator car can be used until a predetermined number of stops. Thereafter, the elevator car can be powered down until the main power supply becomes operative again (block 312).

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of driving an elevator car comprising:

converting alternating current from a main power supply to direct current at a power converter;

converting direct current at the power converter to alternating current at a power inverter;

powering a hoist motor coupled to the power inverter configured to have a regenerative mode;

connecting an isolated bi-directional dc/dc converter between the power converter and the power inverter;

monitoring a voltage level of the main power supply; and based on a determination that the voltage level of the main power supply is below a first predetermined threshold, directing the isolated bi-directional dc/dc converter to boost a voltage input from a battery to a level sufficient to drive the elevator car in a rescue mode, wherein the rescue mode drives the elevator at a low speed in a direction assisted by gravity;

monitoring a voltage level of the battery; and based on a determination that the voltage level of the battery is below a second predetermined threshold and a determination that the voltage level of the main power supply is above the first predetermined threshold, charging the battery via the isolated bi-directional dc/dc converter.

2. The method of claim 1 wherein the level sufficient to drive the elevator car in the rescue mode ranges from approximately 70 to 300 volts.

3. The method of claim 1 further comprising:

monitoring a temperature of the battery; wherein:

charging the battery comprises:

determining an optimum charging cycle for the battery using the voltage level of the battery and the temperature of the battery; and applying the optimum charging cycle to the battery.

4. The method of claim 1 wherein:

charging the battery comprises using power from the main power supply to charge the battery.

5. The method of claim 1 wherein:

charging the battery comprises using power from an elevator hoist motor operating in a regenerative mode to charge the battery.

6. The method of claim 1 wherein:

the isolated bi-directional dc/dc converter is configured to receive a line voltage as input and output a voltage optimal to charge the battery.

7. The method of claim 6 wherein the battery is a 48 volt battery and the voltage optimal to charge the battery is in the range of 50 to 55 volts.

8. The method of claim 6 wherein the line voltage is approximately 380 to 480 volts.

9. An elevator power system comprising:

an input coupled to a main power supply;

a power converter coupled to the input configured to convert between alternating current and direct current;

a power inverter coupled to the power converter configured to convert between alternating current and direct current;

a hoist motor coupled to the power inverter configured to have a regenerative mode;

an isolated bi-directional dc/dc converter coupled between the power converter and the power inverter;

a battery coupled to the isolated bi-directional dc/dc converter; and a processor coupled to the isolated bi-directional dc/dc converter;

wherein the processor is configured to change the mode of operation of the isolated bi-directional dc/dc converter depending on voltage sensed from the power converter and voltage sensed from the battery;

wherein the processor is further configured to:

monitor a voltage level of the battery;

based on a determination that the voltage level of the battery is below a second predetermined threshold and a determination that the voltage level of the main power supply is above the first predetermined threshold, charging the battery via the isolated bi-directional dc/dc converter.

10. The system of claim 9 wherein the level sufficient to drive the hoist motor in the rescue mode ranges from 70 to 300 volts.

11. The system of claim 9 wherein the processor is further configured to:

monitor a temperature of the battery; wherein:

charging the battery comprises:

determining an optimum charging cycle for the battery using the voltage level of the battery and the temperature of the battery; and applying the optimum charging cycle to the battery.

12. The system of claim 9 wherein:

charging the battery comprises using power from the main power supply to charge the battery.

13. The system method of claim 9 wherein:

charging the battery comprises using power from the hoist motor operating in a regenerative mode to charge the battery.

14. The system of claim 9 wherein:

the isolated bi-directional dc/dc converter is configured to receive a line voltage as input and output a voltage optimal to charge the battery.

15. The system of claim 14 wherein the battery is a 48 volt battery and the voltage optimal to charge the battery is in the range of 50 to 55 volts.

16. The system of claim 14 wherein the line voltage is approximately 380 to 480 volts.

* * * * *